US007506863B2

(12) United States Patent
Berke

(10) Patent No.: US 7,506,863 B2
(45) Date of Patent: Mar. 24, 2009

(54) METHODS AND SYSTEMS FOR PROVIDING DIRECTORY PRINTING

(75) Inventor: Eric W. Berke, Atlanta, GA (US)

(73) Assignee: AT&T Intellectual Property I, L.P., Reno, NV (US)

( * ) Notice: Subject to any disclaimer, the term of this patent is extended or adjusted under 35 U.S.C. 154(b) by 569 days.

(21) Appl. No.: 11/227,790

(22) Filed: Sep. 15, 2005

(65) Prior Publication Data

US 2007/0062400 A1 Mar. 22, 2007

(51) Int. Cl.
*B65H 37/00* (2006.01)

(52) U.S. Cl. ..... 270/1.01; 270/18; 270/52.07; 270/52.09

(58) Field of Classification Search ..... 270/1.01, 270/4, 10, 12, 16, 18, 20.1, 52.07, 52.09, 270/52.13

See application file for complete search history.

(56) References Cited

U.S. PATENT DOCUMENTS

| | | | | |
|---|---|---|---|---|
| 5,109,770 | A * | 5/1992 | Uribe et al. | 101/425 |
| 5,526,748 | A * | 6/1996 | Schleinz et al. | 101/488 |
| 2003/0121984 | A1 * | 7/2003 | Pinchen et al. | 235/487 |

* cited by examiner

*Primary Examiner*—Gene Crawford
*Assistant Examiner*—Leslie A Nicholson, III
(74) *Attorney, Agent, or Firm*—Woodcock Washburn LLP

(57) ABSTRACT

Systems and methods are disclosed for providing directory printing. The disclosed systems may include a roll having a first axis. In addition, the systems disclosed may comprise a first print cylinder configured to receive web from the roll. The first print cylinder has a second axis parallel to the first axis and is configured to print a first plurality of rectangular pages on the web from the roll. Each page of the first plurality of rectangular pages has a dimension parallel to the second axis longer than a dimension perpendicular to the second axis. Moreover, the disclosed systems may comprise a collector configured to collect the web from the roll subsequent to the first plurality of pages being printed on the web from the roll.

7 Claims, 5 Drawing Sheets

METHODS AND SYSTEMS FOR PROVIDING DIRECTORY PRINTING

BACKGROUND OF THE INVENTION

I. Field of the Invention

The present invention generally relates to methods and systems for providing directory printing. More particularly, the present invention relates to providing directory printing using a directory press to produce, for example, "midi" directories.

II. Background Information

Directory printing is a process for creating, for example, telephone number directories. Conventional directory printing occurs on a web printing press with page images aligned head-to-foot on a web (i.e. spooled paper) around a printing cylinder. A web press with a 45-½" print cylinder circumference can print up to 4 pages around the print cylinder and 8 pages across (as illustrated in FIG. 2 and described below.) This provides 32 pages per side with a total of 64 pages per web when printed on both sides of the web. After printing, a directory folder receives the web. On a standard directory folder, the web is cut, collected once, and then folded into a finished signature (or group of pages) ready for binding.

A conventional directory page size is 8-15/16"×10-⅞". A directory smaller than this conventional directory size is referred to as a "midi." A conventional midi directory size may comprise 7-½"×8-15/16", however, when this midi size is printed on a conventional web press, there is more than 2" of wasted paper that needs to be trimmed. Thus, the conventional strategy is to print the smaller midi directory on a conventional web press configured to print directory size (i.e. 8-15/16"×10-⅞") directories. This often causes problems because the conventional strategy creates a considerable amount of waste. In the past, midi size directories represented less than 1% of all directory production, so waste was not a major issue. By the end of 2004, however, midi directory volume grew to 6.5 billion pages or 10% of total directory volume. Furthermore, midi directories are expected to grow to 11 billion pages in the future. When the volume was small, there was little incentive to solve the high waste associated with printing the conventional midi size directories. As the midi volume grows, however, solving this waste issue becomes more important.

In view of the foregoing, there is a need for methods and systems for providing directory printing more optimally. Furthermore, there is a need for providing directory printing using a directory press to produce, for example, "midi" directories with less waste.

SUMMARY OF THE INVENTION

Consistent with embodiments of the present invention, systems and methods are disclosed for providing directory printing.

In accordance with one embodiment, a method for providing directory printing comprises providing a roll having a first axis, feeding a web from the roll across a first print cylinder having a second axis parallel to the first axis, the first print cylinder configured to print a first plurality of rectangular pages on the web from the roll, each page of the first plurality of rectangular pages having a dimension parallel to the second axis longer than a dimension perpendicular to the second axis, and collecting the web from the roll subsequent to the first plurality of pages being printed on the web from the roll.

According to another embodiment, a system for providing directory printing comprises a roll having a first axis, a first print cylinder configured to receive a web from the roll, the first print cylinder having a second axis parallel to the first axis, the first print cylinder configured to print a first plurality of rectangular pages on the web from the roll, each page of the first plurality of rectangular pages having a dimension parallel to the second axis longer than a dimension perpendicular to the second axis, and a collector configured to collect the web from the roll subsequent to the first plurality of pages being printed on the web from the roll.

It is to be understood that both the foregoing general description and the following detailed description are exemplary and explanatory only, and should not be considered restrictive of the scope of the invention, as described and claimed. Further, features and/or variations may be provided in addition to those set forth herein. For example, embodiments of the invention may be directed to various combinations and sub-combinations of the features described in the detailed description.

BRIEF DESCRIPTION OF THE DRAWINGS

The accompanying drawings, which are incorporated in and constitute a part of this disclosure, illustrate various embodiments and aspects of the present invention. In the drawings.

DETAILED DESCRIPTION

Figure 1:
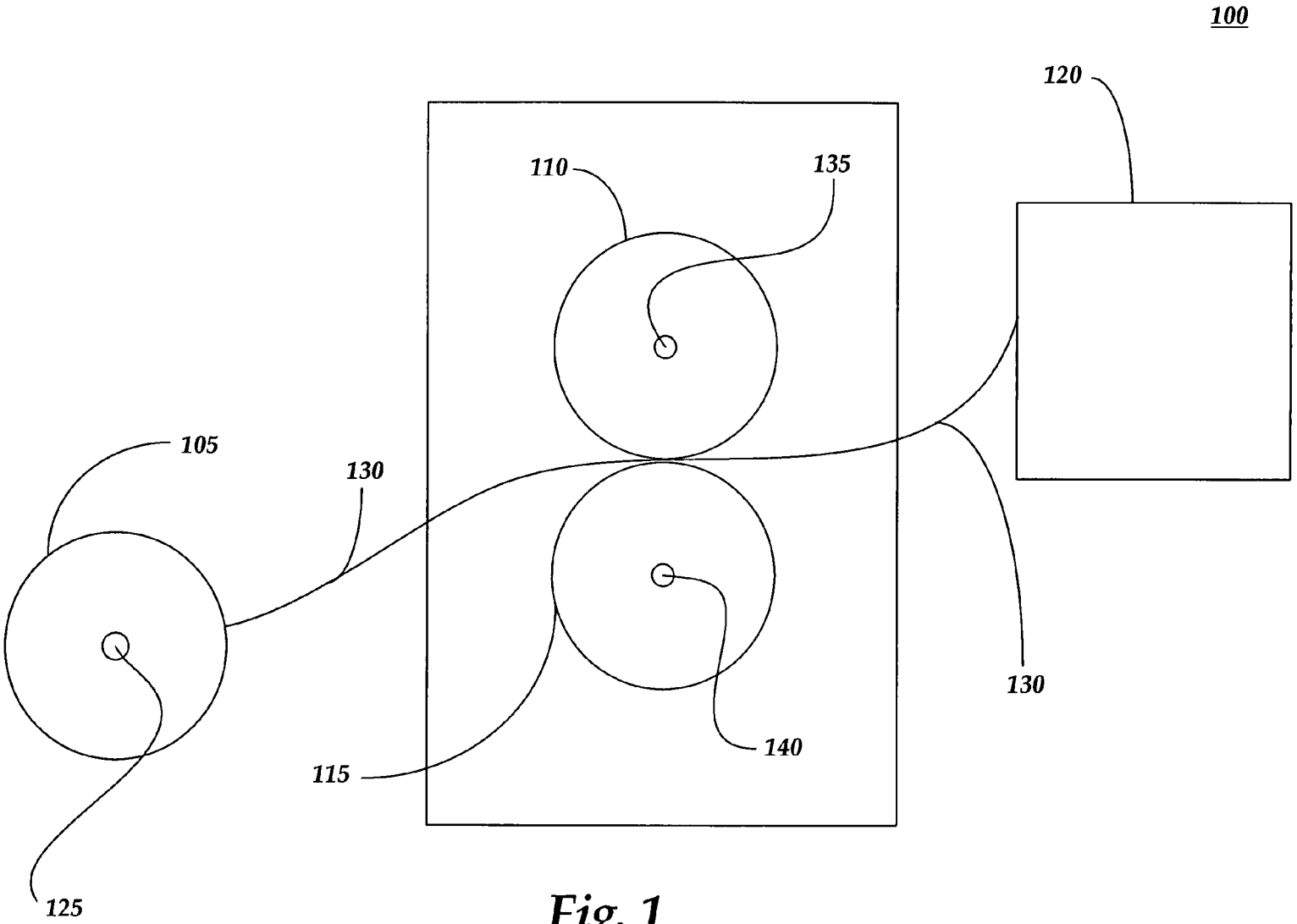
FIG. 1 is a block diagram of an exemplary web printing press consistent with an embodiment of the present invention.

The following detailed description refers to the accompanying drawings. Wherever possible, the same reference numbers are used in the drawings and the following description to refer to the same or similar parts. While several exemplary embodiments and features of the invention are described herein, modifications, adaptations and other implementations are possible, without departing from the spirit and scope of the invention. For example, substitutions, additions or modifications may be made to the components illustrated in the drawings, and the exemplary methods described herein may be modified by substituting, reordering or adding steps to the disclosed methods. Accordingly, the following detailed description does not limit the invention. Instead, the proper scope of the invention is defined by the appended claims.

Systems and methods consistent with embodiments of the present invention provide directory printing. An embodiment consistent with the invention comprises a system for providing directory printing. The system comprises a roll having a first axis. In addition, the system comprises a first print cylinder configured to receive the web from the roll. The first print cylinder has a second axis parallel to the first axis and is configured to print a first plurality of rectangular pages on the web from the roll. Each page of the first plurality of rectangular pages has a dimension parallel to the second axis longer than a dimension perpendicular to the second axis. Moreover, the system may comprise a collector configured to collect web from the roll subsequent to the first plurality of pages being printed on the material from the roll.

Consistent with an embodiment of the present invention, the aforementioned components may be implemented in a web printing press, such as an exemplary web printing press 100 of FIG. 1. The aforementioned web printing press 100 is exemplary and other systems and components may comprise the aforementioned web printing press consistent with embodiments of the present invention.

By way of a non-limiting example, FIG. 1 is a block diagram of an exemplary web printing press 100 consistent with an embodiment of the present invention. in which the features and principles of the present invention may be implemented. As illustrated in the block diagram of FIG. 1, press 100 comprises a roll 105, a first print cylinder 110, a second print cylinder 115, and a collector 120.

In one embodiment, roll 105 is cylindrical and weighs approximately 3,000 pounds. In addition, roll 105 has a length of 73½ inches across, has a 50 inch diameter, and a first axis 125. A web 130 (e.g. paper) is spooled off roll 105 and fed to print cylinders 110 and 115.

First print cylinder 110 is configured to receive web 130 from roll 105. First print cylinder 110 has a second axis 135 parallel to first axis 125. In addition, first print cylinder 110 is configured to print a first plurality of rectangular pages on web 130 from roll 105. Each page of the first plurality of rectangular pages has a dimension parallel to second axis 135 longer than a dimension perpendicular to second axis 135. Collector 120 is configured to collect web 130 from roll 105 subsequent to the first plurality of pages being printed on web 130 from roll 105.

Moreover, second print cylinder 115 is configured to receive web 130 from roll 105. Second print cylinder 115 has a third axis 140 that is parallel to first axis 125. Also, second print cylinder 115 is configured to print a second plurality of rectangular pages on web 130 from roll 105 on a side opposite the first plurality of pages. Each page of the second plurality of rectangular pages has the same dimension as each of the first plurality of pages.

Figure 2:
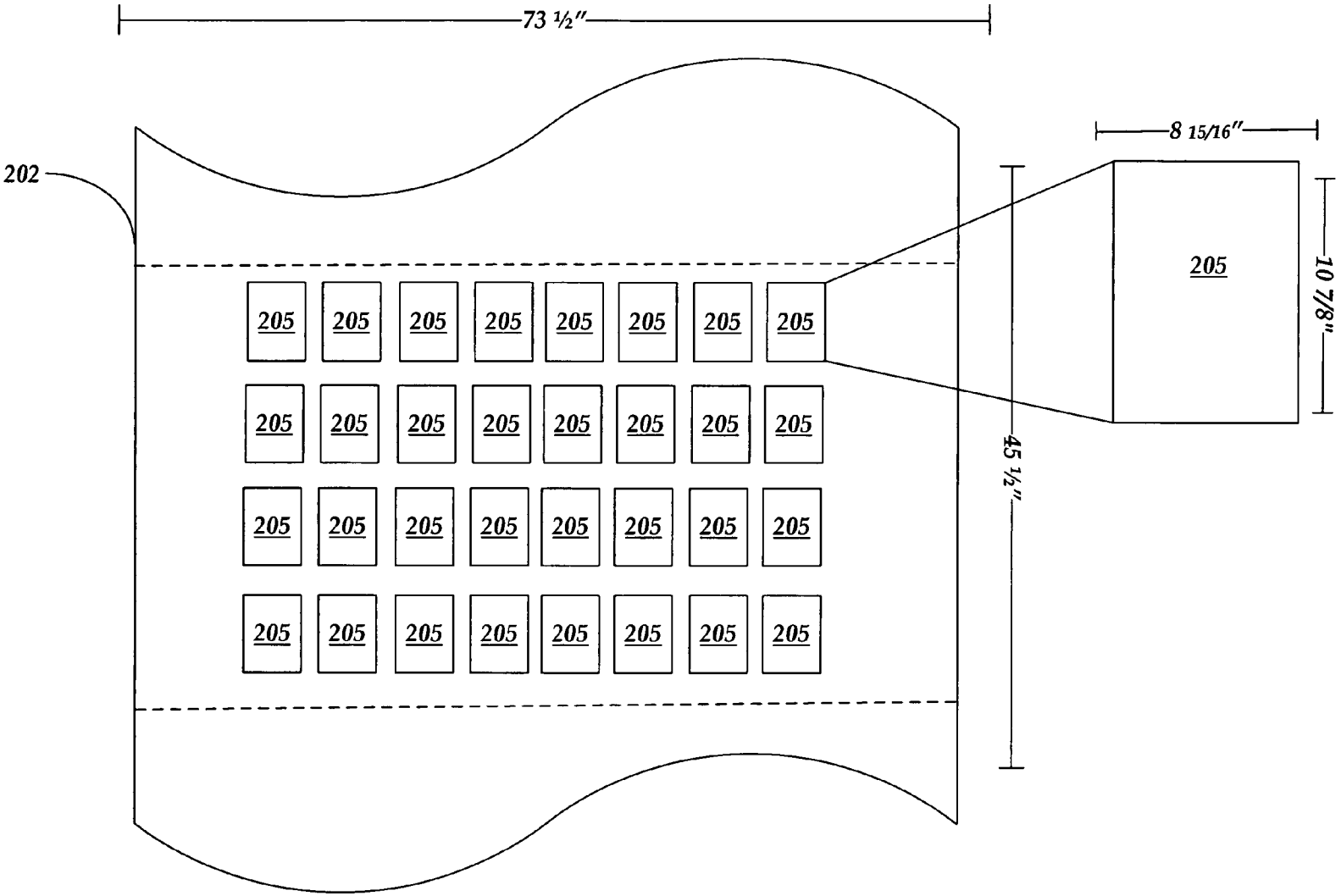
Fig. 2 PRIOR ART
FIG. 2 is a diagram illustrating the layout of a plurality of directory sized pages printed by one revolution of a conventional print cylinder.

FIG. 2 is a diagram illustrating a layout 202 of a plurality of directory sized pages 205 printed by one revolution of a conventional print cylinder. Each page of the plurality of pages has a dimension of 8-15/16"×10-7/8". Conventional directory printing occurs on a web printing press with page images aligned head-to-foot around a printing cylinder. A web press with a 45-½" cylinder circumference and being fed by a 73-½" web can, as shown in FIG. 2, prints up to 4 pages around the cylinder and 8 pages across. This provides 32 pages per web side.

Figure 3:
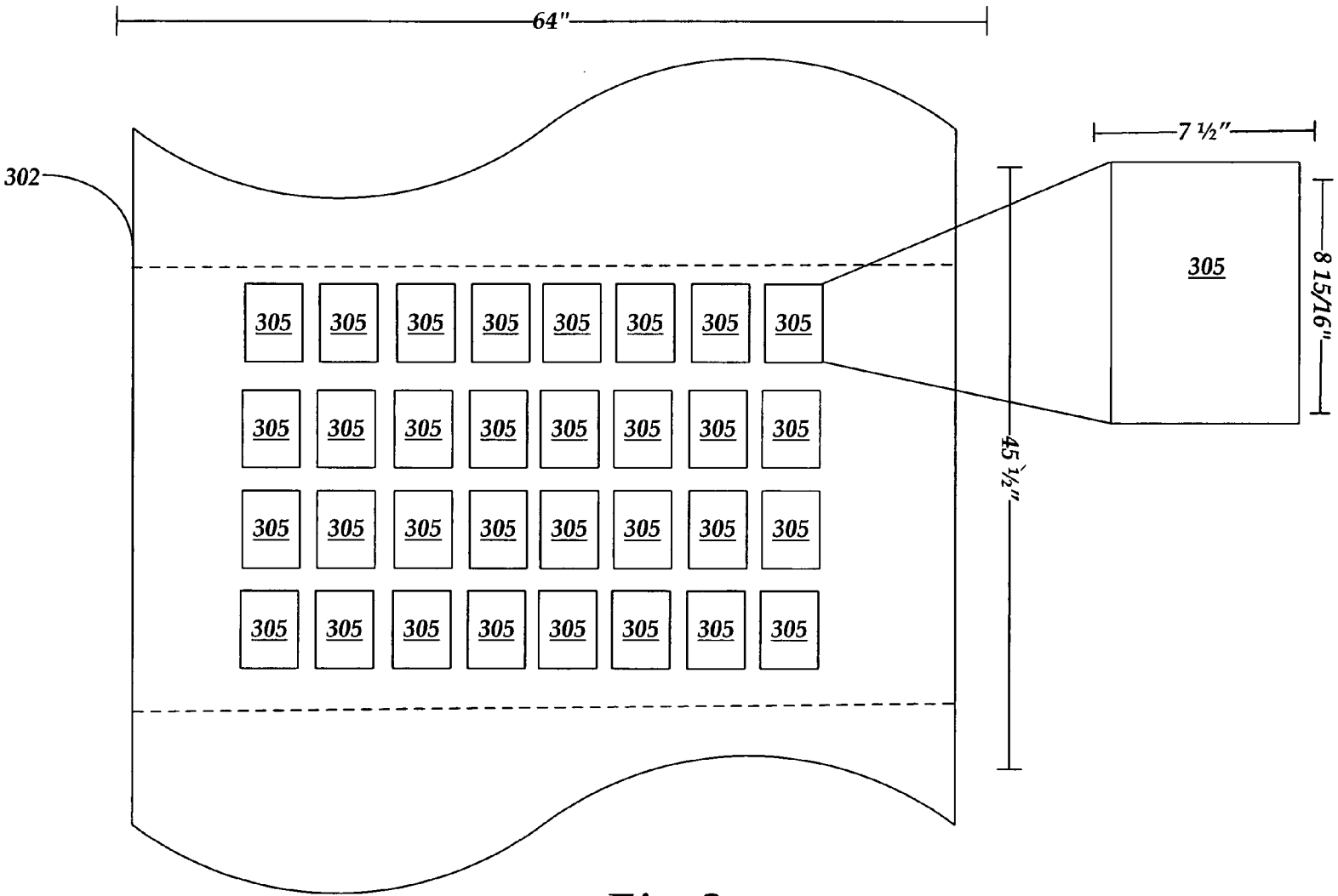
Fig. 3 PRIOR ART
FIG. 3 is a diagram illustrating the layout of a plurality of conventional midi sized pages printed by one revolution of a conventional print cylinder.

FIG. 3 is a diagram illustrating a layout 302 of a plurality of conventional midi sized pages 305 printed by one revolution of a conventional print cylinder. Each page of the plurality of pages has a dimension of 7-½"×8-15/16". Conventional midi directory printing occurs on a web printing press with page images aligned head-to-foot around a printing cylinder. A web press with a 45-½" cylinder circumference and being fed by a 64" web can, as shown in FIG. 3, prints up to 4 pages around the cylinder and 8 pages across. This provides 32 pages per web side. Conventional midi size (7-½"×8-15/16") pages, produced in this manner, results in approximately 36% trim waste.

Figure 4:
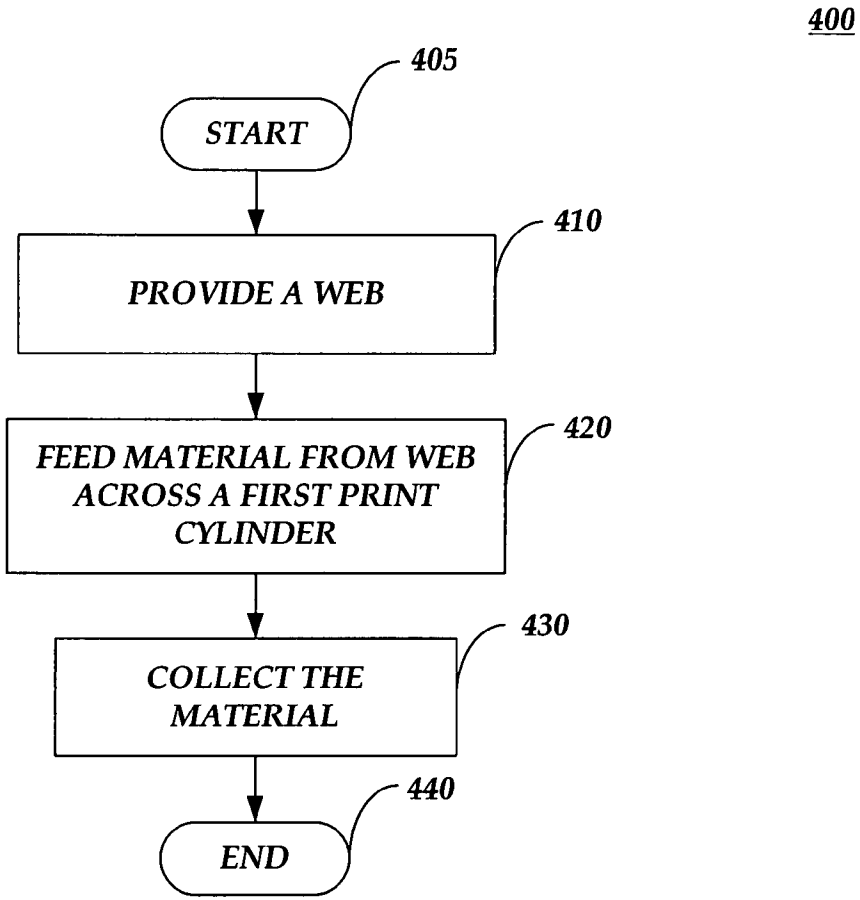
FIG. 4 is a flow chart of an exemplary method for providing directory printing consistent with an embodiment of the present invention.

FIG. 4 is a flow chart setting forth the general stages involved in an exemplary method 400 consistent with the invention for providing directory printing using press 100 of FIG. 1. Exemplary ways to implement the stages of exemplary method 400 will be described in greater detail below. Exemplary method 400 begins at starting block 405 and proceeds to stage 410 where press 100 provides roll 105 having first axis 125. For example, roll 105 is cylindrical and weighs approximately 3,000 pounds. Moreover, roll 105 has a length of 73½ inches across and has a 50 inch diameter. Web 130 (e.g. paper) is spooled off roll 105 and fed to print cylinders 110 and 115.

Figure 5:
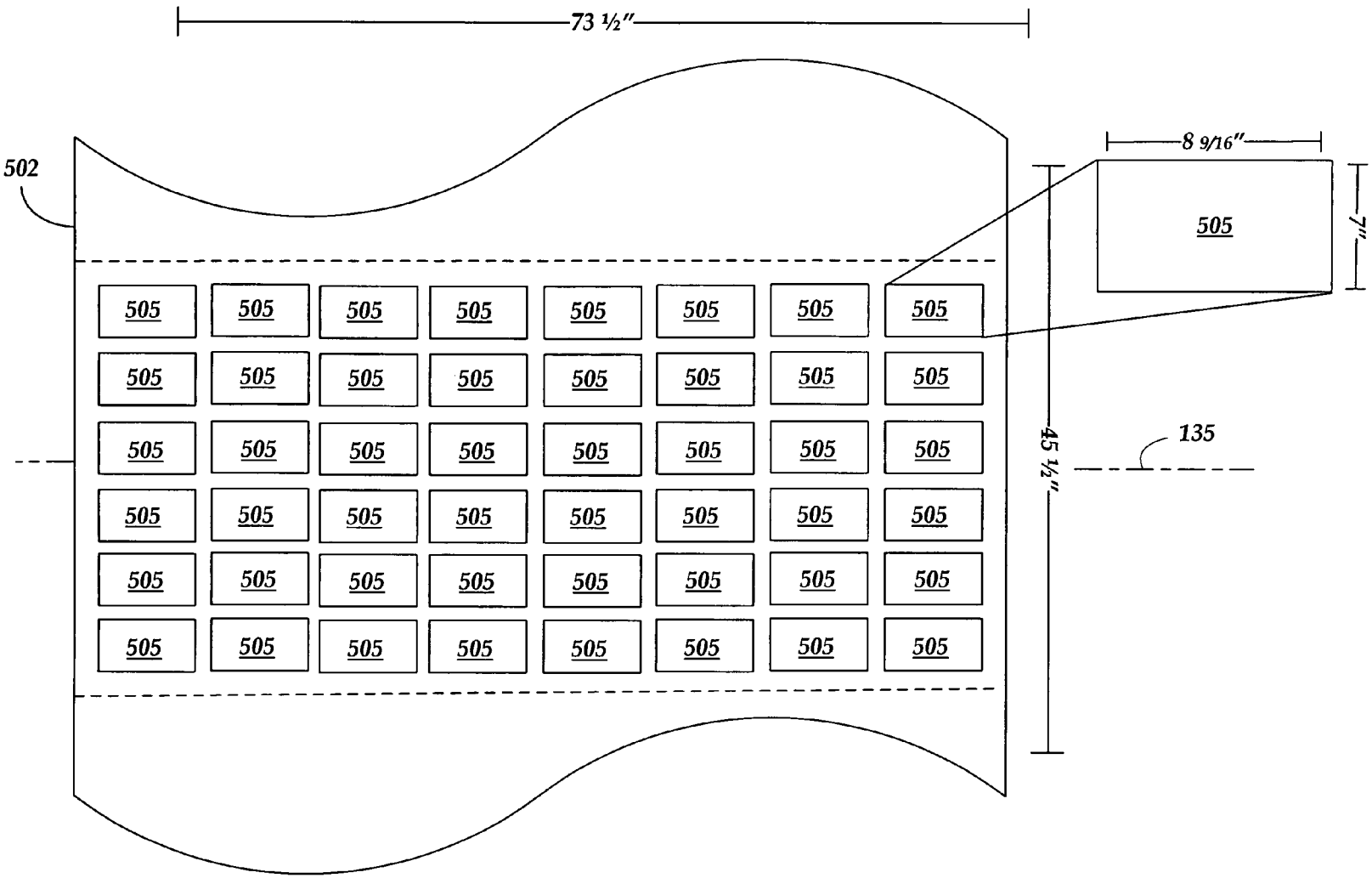
FIG. 5 is a diagram illustrating the layout of a plurality of midi sized pages printed by one revolution of a print cylinder consistent with an embodiment of the present invention.

From stage 410, where press 100 provides roll 105, exemplary method 400 advances to stage 420 where press 100 feeds web 130 from roll 105 across first print cylinder 110. First print cylinder 110 has second axis 135 parallel to first axis 125. As shown in FIG. 5, first print cylinder 110 is configured to print a first plurality of rectangular pages 505 on web 130 from roll 105. Each page of first plurality of rectangular pages 505 has a dimension parallel to second axis 135 longer than a dimension perpendicular to second axis 135. For example, in contrast to the conventional midi sized pages shown in FIG. 3, the first plurality of rectangular pages 505 shown in FIG. 5 are rotated 90 degrees relative to the pages shown in FIG. 3. Moreover, consistent with embodiments of the present invention, first plurality of rectangular pages 505 has a midi size of 7"×8-9/16". Consistent with embodiments of the invention, the 7"×8-9/16" midi size enables production of up to 48 pages per side verses the conventional midi size (i.e. 7-½"×8-15/16") producing only 32 pages per side.

In other words, consistent with embodiments of the invention, page images are rotated 90 degrees (relative to conventional processes) so that the head-to-foot dimension is perpendicular to print cylinder circumference. Accordingly, 6 pages may be printed around the print cylinder and 8 pages across (i.e. 48 pages per side). Printing on both sides of web 130 with second print cylinder 115, 96 pages are printed. This provides 1.5 times the normal number of pages printed under conventional processes.

Consistent with embodiments of the present invention, printing is performed using laser engraved aluminum plates mounted on print cylinders 110 and 115. For example, computer files, may be received containing, for example, photographic images, drawings, and text that is to be printed on the pages. Next, pages associated with the computer files are oriented in desired directions in order to image them onto printing plates 110 and 115. The aforementioned printing process is exemplary and others may be used.

Consistent with embodiments of the present invention, printing plates 110 and 115 are laser engraved with a thermal laser. For example, the printing plates comprise an aluminum alloy toped with a coating made of polymers that react to a laser's heat. Accordingly, the computer file's content is placed on the surface of printing plates 110 and 115 by removing the polymer coating in appropriate places on printing cylinders 110 and 115.

Printing cylinders 110 and 115 may use the principle that oil and water do not mix so on that the image areas are ink receptive. The non-image areas are water receptive, in other words they resist ink and attract water. Accordingly, when printing cylinders 110 and 115 are pressed through a series of conventional rollers that place water and ink on the cylinders, the ink sticks to the image areas that are then transferred to a conventional rubber blanket cylinder. Then the image may be transferred from the rubber blanket cylinder to the roll 105.

Once press 100 feeds web 130 from roll 105 across first print cylinder 110 in stage 420, exemplary method 400 continues to stage 430 where press 100 collects web 130 from roll 105 subsequent to first plurality of pages 505 being printed on web 130 from roll 105. For example, collector 120 is configured to collect web 130 from roll 105 subsequent to first plurality of pages 505 being printed on web 130 from roll 105.

Conventional collectors cut and collect two pieces together to fold. Consistent with embodiments of the invention, collector 120 cuts twice and collects three pieces together for folding. Collector 120 allows for utilizing more of the total press surface area by matching the midi page orientation to the existing press circumference. After press 100 collects web 130 from roll 105 in stage 430, exemplary method 400 then ends at stage 440.

Furthermore, the invention may be practiced using electrical circuits comprising discrete electronic elements, packaged or integrated electronic chips containing logic gates, a circuit utilizing a microprocessor, or on a single chip containing electronic elements or microprocessors. The invention may also be practiced using other technologies capable of performing logical operations such as, for example, AND, OR, and NOT, including but not limited to mechanical, optical, fluidic, and quantum technologies. In addition, the invention may be practiced within a general purpose computer or in any other circuits or systems.

The present invention may be embodied as systems, methods, and/or computer program products. Accordingly, the present invention may be embodied in hardware and/or in software (including firmware, resident software, micro-code, etc.). Furthermore, embodiments of the present invention may take the form of a computer program product on a computer-usable or computer-readable storage medium having computer-usable or computer-readable program code embodied in the medium for use by or in connection with an instruction execution system. In the context of this document, a computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

The present invention is described above with reference to block diagrams and/or operational illustrations of methods, systems, and computer program products according to embodiments of the invention. It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved.

While certain features and embodiments of the invention have been described, other embodiments of the invention will be apparent to those skilled in the art from consideration of the specification and practice of the embodiments of the invention disclosed herein. Furthermore, although embodiments of the present invention have been described as being associated with data stored in memory and other storage mediums, one skilled in the art will appreciate that these aspects can also be stored on or read from other types of computer-readable media, such as secondary storage devices, like hard disks, floppy disks, or a CD-ROM, a carrier wave from the Internet, or other forms of RAM or ROM. Further, the steps of the disclosed methods may be modified in any manner, including by reordering steps and/or inserting or deleting steps, without departing from the principles of the invention.

It is intended, therefore, that the specification and examples be considered as exemplary only, with a true scope and spirit of the invention being indicated by the following claims and their full scope of equivalents.

What is claimed is:

1. A method for providing directory printing, the method comprising:

providing a web having a first axis;

feeding material from the web across a first print cylinder having a second axis parallel to the first axis, the first print cylinder configured to print a first plurality of rectangular pages of the directory printing on the material from the web, each page of the first plurality of rectangular pages having a dimension parallel to the second axis shorter than a dimension perpendicular to the second axis, wherein feeding the material comprises feeding the material wherein each of the first plurality of rectangular pages comprises the following dimension: 7 inches by 8 and 9/16 inches;

collecting the material from the web subsequent to the first plurality of pages being printed on the material from the web to form the directory printing, and reconfiguring the first print cylinder to print a second plurality of rectangular pages on the material from the web, each page of the second plurality of rectangular pages having a dimension parallel to the second axis longer than a dimension perpendicular to the second axis, wherein the second plurality of rectangular pages comprises at least one different dimension than the first plurality of rectangular pages.

2. The method of claim 1, wherein feeding the material from the web further comprises feeding the material comprising paper.

3. The method of claim 1, wherein feeding the material from the web across the first print cylinder comprises feeding the material from the web across the first print cylinder having a dimension comprising the following: a circumference of 45.5 inches and a length of 73.5 inches.

4. The method of claim 1, wherein feeding the material from the web across the first print cylinder comprises feeding the material from the web across the first print cylinder having a dimension associated with a directory printer print cylinder.

5. The method of claim 1, wherein feeding the material from the web across the first print cylinder having the second axis parallel to the first axis, the first print cylinder configured to print the first plurality of rectangular pages comprises the first print cylinder configured to print 48 of the first plurality of rectangular pages per revolution of the first print cylinder.

6. The method of claim 1, wherein feeding the material from the web across the first print cylinder having the second axis parallel to the first axis, the first print cylinder configured to print the first plurality of rectangular pages comprises the first print cylinder configured to print using offset printing.

7. The method of claim 1, further comprising feeding the material from the web across a second print cylinder having a third axis parallel to the first axis, the second print cylinder configured to print a second plurality of rectangular pages on the material from the web on a side opposite the first plurality of pages, each page of the second plurality of rectangular pages having the same dimension as each of the first plurality of pages.

* * * * *